United States Patent [19]

Martin

[11] 3,990,216

[45] Nov. 9, 1976

[54] BAG CLOSING AND FEEDING APPARATUS

[76] Inventor: William F. Martin, 8932-48th Ave. North, Minneapolis, Minn. 55428

[22] Filed: May 5, 1975

[21] Appl. No.: 575,051

[52] U.S. Cl. ..... 53/371; 214/1 BB

[51] Int. Cl.[2] ..... B65B 7/06

[58] Field of Search ..... 53/371, 387, 285, 139, 53/373, 198 A, 266; 214/1 BB

[56] References Cited

UNITED STATES PATENTS

| | | | |
|---|---|---|---|
| 1,551,522 | 8/1925 | Erickson | 53/371 X |
| 2,721,018 | 10/1955 | Heavin | 53/266 |
| 2,911,778 | 11/1959 | Ozor | 53/371 |
| 3,241,290 | 3/1966 | Ingleson et al. | 53/371 |
| 3,313,089 | 4/1967 | Rustad et al. | 53/371 |
| 3,362,545 | 1/1968 | Rowe | 214/1 BB |
| 3,896,605 | 7/1975 | Chevalier et al. | 53/371 X |

*Primary Examiner*—Travis S. McGehee
*Assistant Examiner*—Horace M. Culver
*Attorney, Agent, or Firm*—Merchant, Gould, Smith, Edell, Welter & Schmidt

[57] ABSTRACT

Apparatus for closing and feeding filled bags to conveyor mechanisms of bag tying mechanisms includes a frame and guide rails which support and guide a mounting head for reciprocatory movements in the direction of movement of the conveying mechanism. Lever arms on the mounting head clamp and close the upper portion of the filled bag. First and second pressure operated rams are operatively mounted to impart reciprocatory movements to the mounting head and clamping movements to the lever arms respectively. A reversing valve is connected to a source of fluid under pressure and to the first and second pressure operated rams for controlling the reciprocatory movements imparted to the mounting head by the first pressure operated ram and the movement imparted to the lever arms by the second pressure operated ram in a predetermined sequence.

3 Claims, 5 Drawing Figures

BAG CLOSING AND FEEDING APPARATUS

BACKGROUND OF THE INVENTION

The present invention relates generally to bag tying operations and more specifically to a bag closing and feeding apparatus for advancing a filled bag from a bag filling machine to the conveyor mechanism of bag tying mechanism.

Previously, one method of advancing the filled bags has been to transfer the bag from a filling device to a bag tying device manually. However, this practice is not entirely satisfactory since it is time consuming and has become increasingly costly due to the high cost of labor. In addition, the possibility of accidental injury or dismemberment is always present during attempts at feeding articles into machines by hand. This, of course, results in the development of complicated and often expensive safety devices for such hand fed mechanisms. A further method of advancing filled bags to the bag tying mechanism is by additional conveyor devices, such as belt conveyors. These devices however, do not normally function to close the top of the bag prior to presentation to the conveyor mechanism of the bag tying device, nor do they assure proper orientation of the filled bag as it is fed to the conveyor mechanism.

SUMMARY OF THE INVENTION

With the above in mind, it is a principle object of the present invention to provide a device of the class described which will advance a filled bag from a bag filling machine to a bag tying machine in the proper orientation and without manual manipulation of the filled bag.

It is a further object of the present invention to provide a device of the class above described which is relatively inexpensive to produce, which is easily adaptable to present bag tying devices, and which is extremely reliable in operation.

In view of the above, the present invention includes a frame adapted to be mounted on the bag tying and conveying mechanism. A guide on the frame supports and guides a mounting head for reciprocatory movements in a given horizontal direction. A first fluid pressure operated ram is mounted on the frame for imparting the reciprocatory movements to the mounting head. A pair of lever arms are pivotally mounted on the mounting head for clamping movements of one end of each lever arm toward and away from the other lever arm in directions extending generally transversely of the reciprocatory movement. A second fluid pressure operated ram, on the mounting head, has connecting means operatively associated with the second fluid pressure operated ram and the lever arms for imparting the clamping movements to the lever arms and a reversing valve is connected to a source of fluid under pressure for controlling the reciprocatory movements imparted to the mounting head by the first pressure operated ram and the movements imparted to the lever arms by the second pressure operated ram in a predetermined sequence.

DETAILED DESCRIPTION OF THE PREFERRED EMBODIMENT

Figure 1:
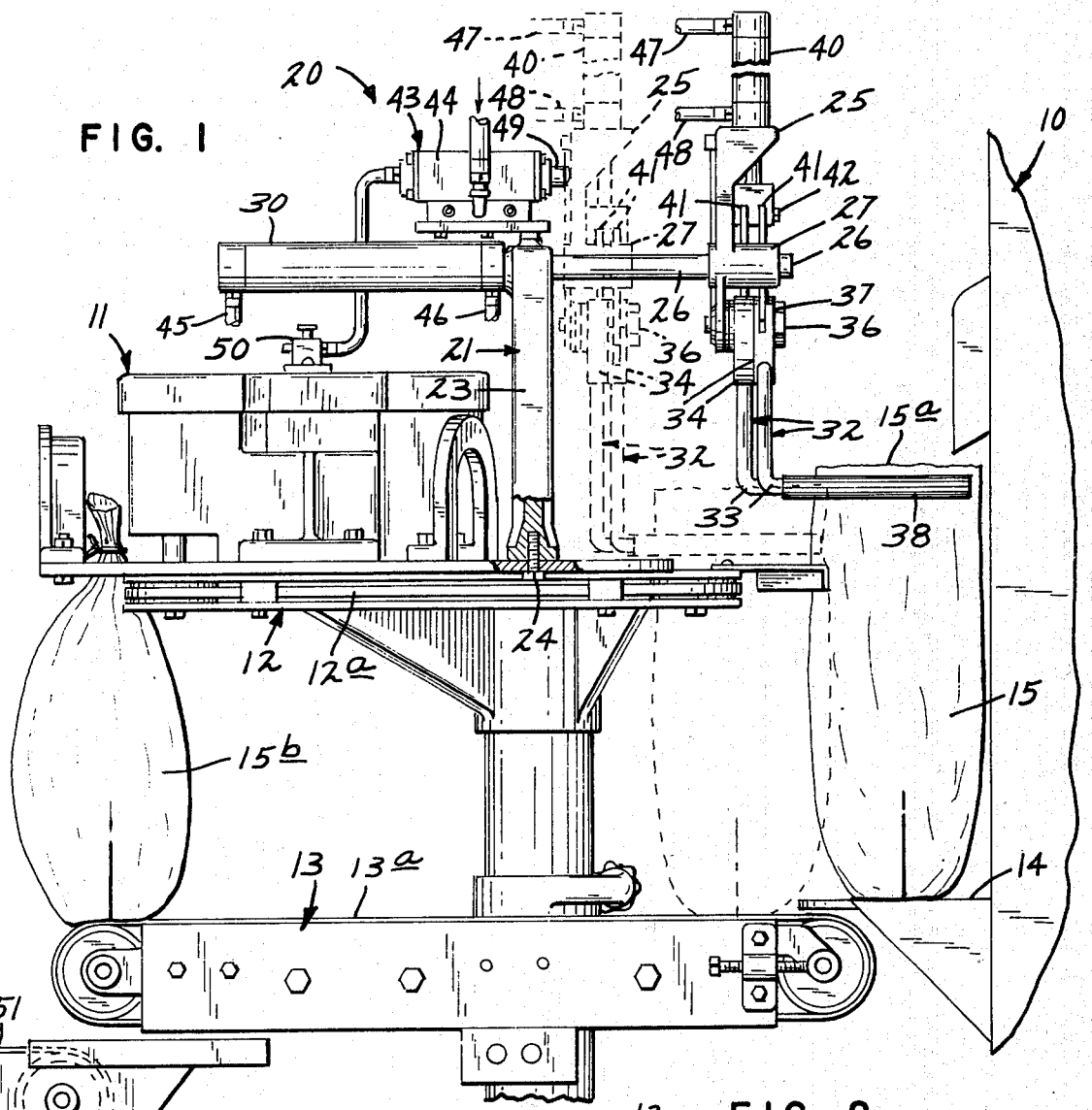
FIG. 1 is a fragmentary view in side elevation of a bag filling mechanism and bag tying mechanism showing the present invention mounted thereon.
Figure 2:
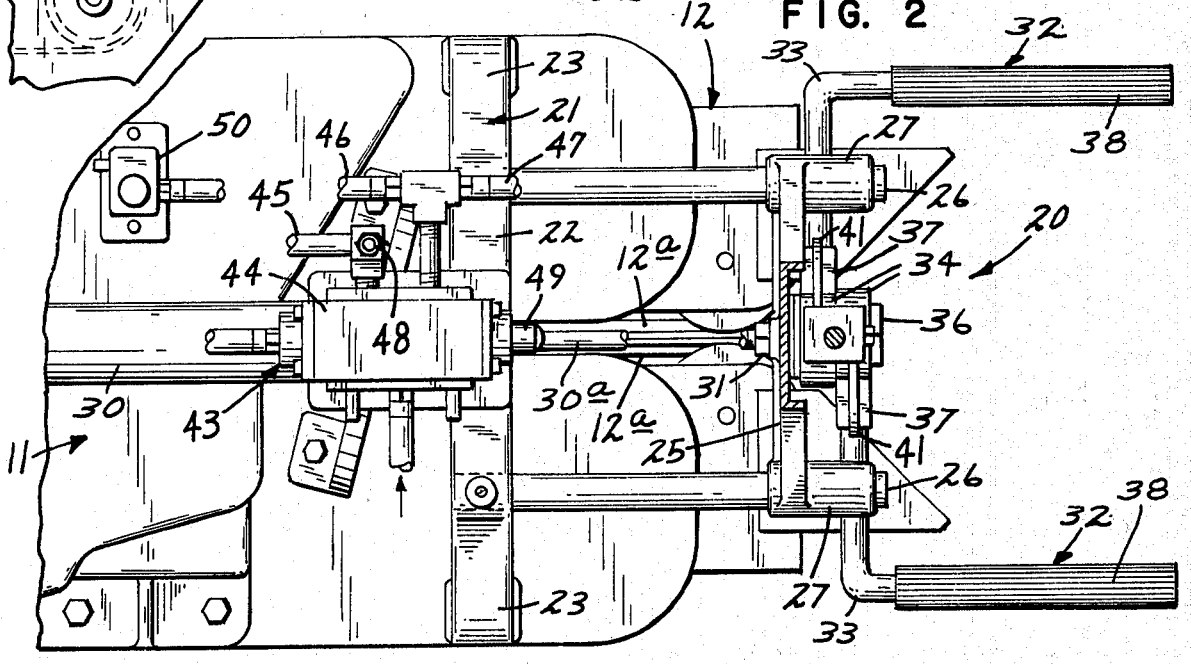
FIG. 2 is a fragmentary view in top plan of a portion of the structure of FIG. 1 on a slightly enlarged scale.

Referring now with greater particularity to the drawings wherein like reference characters indicate like parts throughout the several views, the numeral 10 indicates a fragmentary showing of a bag filling device and the numeral 11 indicates a fragmentary showing of a bag tying mechanism having upper and lower conveyor mechanism 12, 13 respectively, for advancing a filled bag to the bag tying mechanism 11. The bag filling device 10 includes a shelf 14 for supporting a bag 15 during the filling operation. The bag filling device 10 and bag tying mechanism 11 are machines which are presently manufactured for sale and therefore specific mechanical details and operation thereof are not shown, it being understood that the bag filling device 10 and bag tying mechanism 11 shown are for illustrative reasons only.

In operation it is necessary for the filled bag 15 to be advanced onto the conveyor 13 and into engagement with the conveyor 12. Conveyors 12, 13 operate in a direction to feed the bag 15 to the bag tying mechanism 11 such that the upper end **15*a* of the bag 15 may be tied as illustrated by the bag 15*b*. It will be here noted that the upper conveyor 12 is a pair of belts 12*a* entrained over suitable pulleys so as to be disposed in a horizontal plane and in engagement with each other along a center line of the bag tying mechanism 11 and the lower conveyor mechanism is a relatively flat belt which defines a flat upper surface 13*a*. The conveyor mechanisms 12, 13 are driven in a direction to feed a bag 15 to the bag tying mechanism 11 by appropriate power means and mechanical connections, not shown, which drive the conveyor mechanisms 12, 13 at identical speeds and at a speed required by the bag tying mechanism 11.**

For the purpose of closing the top **15*a* of a filled bag 15 and advancing the bag 15 from the shelf 14 to the upper and lower conveyor mechanisms 12, 13 in a correctly orientated position, there is provided a bag closing and feeding apparatus indicated generally by a numeral 20. As shown, apparatus 20 includes a frame 21 of generally U-shape having an upper connecting portion 22 and spaced depending leg portions 23 adapted to straddle the upper conveyor mechanism 12. The frame 21 is secured to the upper surface of the upper conveyor mechanism 12, as at 24.**

Guide means for supporting and guiding a mounting head 25 for reciprocatory movements in a given horizontal direction (parallel to the conveying movements of the conveyor mechanism 12, 13) include a pair of horizontally extended spaced parallel rails 26 mounted on the frame 21. Spaced bearing portions 27 on the mounting head 25 each receive a different one of the rails 26 and mount the mounting head 25 for sliding engagement on the rails 26. As shown particularly in FIG. 1 of the drawings, the rails 26 are mounted on the frame 21 to extend in a direction away from the bag tying mechanism 11 for a reason which will become apparent hereinafter.

A first fluid pressure operated ram 30 is mounted on the frame 21 for imparting the reciprocatory movements to the mounting head 25. The first pressure operated ram 30 is mounted centrally on the upper connecting portion 22 and includes a piston rod 30*a* having a longitudinal axis extending parallel to the direction of the reciprocatory movement of the mounting head 25 and a free end which is connected to the mounting head 25 centrally between the bearing portions 27, as at 31. The particular connection as at 31, is such as to provide a slight amount of adjustment to the mounting head 25 in directions longitudinally of the piston rod 30*a*.

A pair of lever arms 32 are pivotally mounted on the mounting head 25 for clamping movements of one end 33 of each lever arm toward and away from the other lever arm in directions extending generally transversely of the reciprocatory movement of the mounting head 25. Each of the lever arms 32 comprise relatively long arm portions of bell cranks forming the above mentioned one end 33, the lever arms 32 being hereinafter referred to as bell cranks 32. Each bell crank 32 further includes a generally flat portion 34 having an aperture 35 formed therethrough on an axis perpendicular to the plane of a respective flat portion 34. The mounting head 25 includes a mounting pin 36 in the form of a shouldered bolt extending through the apertures 35 in the flat portions 34 and having screw threaded engagement with head 25. The pin 36 is located centrally of the mounting head 25 below the connection 31 of piston rod 30a. Each of the flat portions 34 is so formed as to provide a relatively short crank arm portion 37 of the bell crank 32. Also, each of the bell cranks 32 includes a horizontally disposed clamping portion 38 which extends longitudinally of the direction of the reciprocatory movement of the mounting head 25. The particular mounting of the relatively flat portions 34 provides a simple arrangement wherein the bell cranks 32 are mounted for pivotal movements on a common axis such that they may be brought into tight clamping engagement, as shown particularly in FIG. 4.

Figure 3:
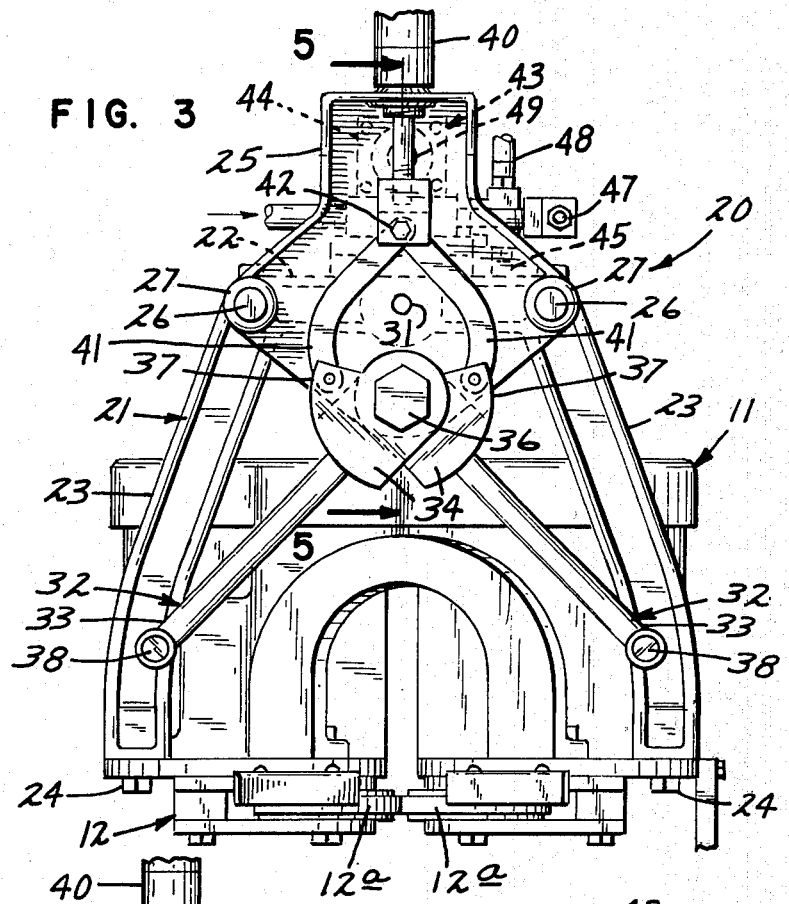
FIG. 3 is an enlarged elevational view as seen from right to left of FIG. 1, portions thereof being broken away.

For the purpose of imparting clamping movements to the bell cranks 32 a second fluid pressure operated ram 40 is mounted on the mounting head 25 in overlying relationship to the bell cranks 32 and with the longitudinal axis thereof bisecting the mounting pin 36. Connecting means operatively associated with the second fluid pressure operated ram 40 and the bell cranks 32 for imparting movements to the bell cranks 32 comprise a pair of rigid links 41. Each link 41 has one end pivotally connected to a different one of the relatively short crank arm portions 37 of the bell crank 32 and the other ends connected to a piston rod of the second fluid pressure operated ram 40, as at 42. This particular arrangement of parts assures equal movement of the bell cranks 32 between their clamping and open positions of FIGS. 3, 4.

Reversing valve means includes a reversing valve 43 connected to a source of fluid under pressure for controlling reciprocatory movements imparted to the mounting head 25 by the first pressure operated ram 30 and movements imparted to the bell cranks 32 by the second pressure operated ram 40 in a predetermined sequence to move the filled bag 15 from the full line position of FIG. 1 to the dotted line position thereof. The reversing valve 43 is of a conventional type including a housing 44 ported to direct the flow of fluid from the source, not shown, through the appropriate conduits 45–48. The flow of fluid through the appropriate conduits 45–48 is controlled by a spool 49 slidably engaged within the housing 44 to align appropriate ports in a manner not shown, but well known in the art. A remote control valve member 50 is connected to the housing 44 such that operation thereof will initiate a bag feeding cycle as will be hereinafter described.

OPERATION

Figure 4:
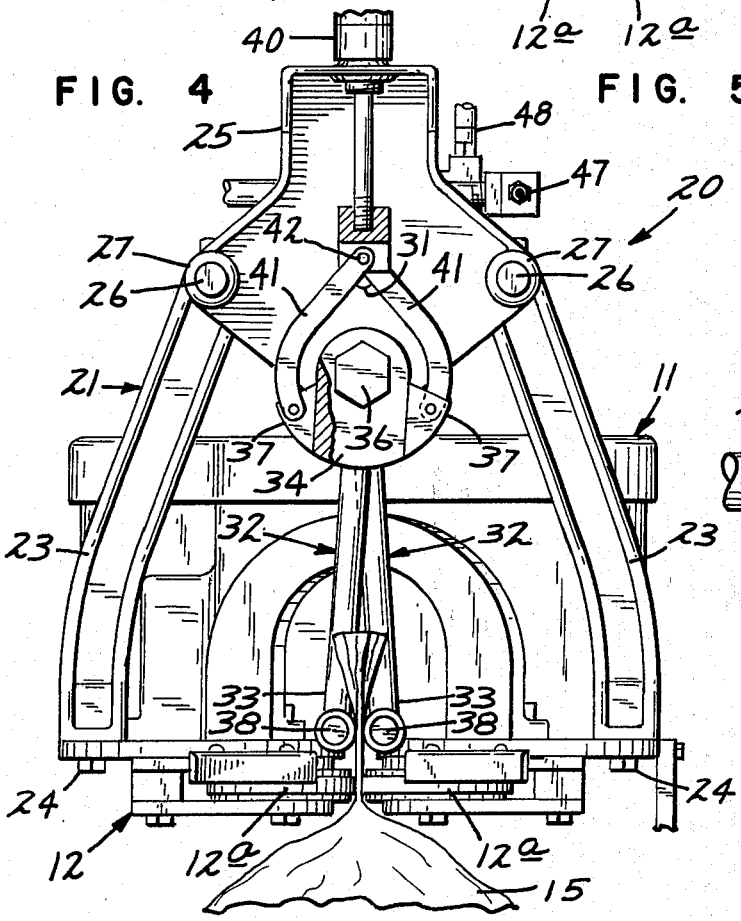
FIG. 4 is a view similar to FIG. 3 illustrating a different position of the bag closing end clamping arm.
Figure 5:
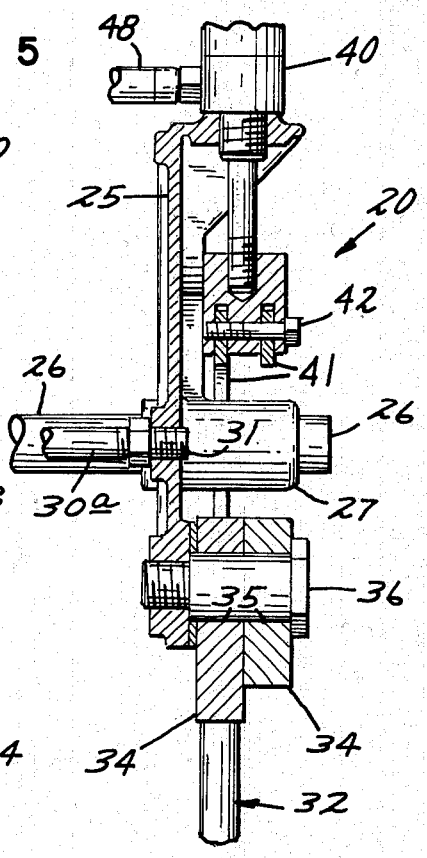
FIG. 5 is an enlarged vertical section as seen generally from the lines 5—5 of FIG. 3.

When it is desired to advance a filled bag 15 from the full line position of FIG. 1 on the platform 14 to the dotted line position therein, remote control 50 is operated to cause the spool 49 to be moved to a position to cause a flow of fluid to the first and second pressure operated cylinders 30, 40 through the fluid conduits 46, 47 respectively and to be exhausted through the conduits 45, 48 respectively. The preferred source of fluid under pressure is pneumatic and therefore the fluid exhausted through the conduits 45, 48 is exhausted through the reversing valve 43 to atmosphere. As shown, reversing valve 43 is mounted on the frame 21 in a position wherein the spool valve 49 is engaged by the mounting head 25 as will be presently described. Introduction of fluid under pressure to the fluid conduits 46, 47 causes the second pressure operated ram 40 to impart bag closing or clamping movements to the bell cranks 32 to move them from the position shown in FIG. 3 to that shown in FIG. 4. As can be seen in FIG. 4 clamping movements of the bell cranks 32 closes the bag 15 along a line defined by the clamping portions 38. As this takes place, fluid pressure in the conduit 46 causes the first hydraulic ram 30 to impart movements to the mounting head 25 from the full line position of FIG. 1 to the dotted line position thereof. This movement removes the bag 15 from the shelf 14 and deposits it on the upper surface 13*a* of the lower conveyor 13 with the upper end 15*a* of the bag 15 positioned between the adjacent portions of the upper conveyor belts 12*a*. As the bag 15 is received between the conveyor belts 12*a* mounting head 25 engages the reversing spool 49 of reversing valve 43 and reverses the flow of fluid through the valve 43. Thus, fluid pressure is now shifted to the conduits 45, 48 causing the first and second fluid pressure operated rams 30, 40 to return the mounting head 25 and lever arms 34 to their full line positions of FIGS. 1 and 3 in position for bag closing and feeding operations on a subsequent bag 15 being filled by the machine 10. The remote control valve member 50 is again depressed to initiate operation of the bag closing and feeding apparatus 20. Because the upper and lower conveyor mechanisms 12, 13 are synchronized to travel at a common speed the filled bags 15 are conveyed to the bag tying mechanism 11 in a upright position suitable for tying of the upper end 15*a* by the bag tying mechanism 11 as illustrated by the tied bag 15*b*. From this point, bag 15*b* is deposited on another conveyor mechanism or the like 51 for subsequent storage.

I claim:

1. A bag closing and feeding apparatus for use with a bag-tying mechanism and a conveyor mechanism for conveying full bags to the bag-tying mechanism, said bag closing and feeding apparatus comprising:

a. a frame adapted to be mounted on a bag-tying and conveying mechanism;

b. a mounting head;

c. guide means for supporting and guiding said mounting head for reciprocatory movements in a given horizontal direction;

d. a first fluid pressure operated ram mounted on said frame for imparting said movements to said mounting head;

e. a pair of bell cranks pivotally mounted intermediate their ends to said mounting head on a common axis extending longitudinally of said movements of the head, said bell cranks each including relatively long and relatively short lever arms;

f. said relatively long lever arms each including a generally horizontal bag engaging and clamping portion extending in the direction of travel of said mounting head and movable toward and away from the clamping portion of the other relatively long lever arm;

g. a second fluid pressure operated ram including a cylinder mounted on said mounting head in overlying relationship to said bell cranks and a movable piston projecting axially downwardly from said cylinder, said second ram having an extended axis intersecting the axis of pivotal movement of said bell cranks;

h. a pair of rigid links pivotally connected at one end to said piston rod on an axis parallel to the direction of movement of said mounting head and their other ends each to the relatively short lever arm of a different one of said bell cranks on axes parallel to said direction of mounting head movement;

i. a valve mechanism adapted to be connected to a source of fluid under pressure and having fluid connections to said rams for controlling movements of said mounting head and said bell cranks.

2. The bag closing and feeding apparatus defined in claim 1 in which said valve mechanism includes a reversing valve operative responsive to movement of said mounting head in one direction to cause said second ram to impart bag-releasing movements to said bell cranks.

3. The structure of claim 1 wherein said frame is of inverted generally U-shape having an upper connecting portion and spaced depending leg portions adapted to straddle the conveyor mechanism, wherein said guide means is a pair of horizontally extended spaced parallel rails mounted on said frame, and wherein said mounting head includes spaced bearing portions mounted for sliding engagement on said parallel rails.

* * * * *